US007771546B2

(12) United States Patent
Nakaoka et al.

(10) Patent No.: US 7,771,546 B2
(45) Date of Patent: Aug. 10, 2010

(54) SEMI-HARD MAGNETIC MATERIAL, BIAS MATERIAL FOR MAGNETIC MARKER, MAGNETIC MARKER AND PRODUCTION METHOD OF BIAS MATERIAL FOR MAGNETIC MARKER

(75) Inventors: Noriyuki Nakaoka, Yasugi (JP); Shinichiroh Yokoyama, Tokyo (JP); Yoshiyuki Fujihara, Yasugi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 12/058,218

(22) Filed: Mar. 28, 2008

(65) Prior Publication Data

US 2008/0240971 A1 Oct. 2, 2008

(30) Foreign Application Priority Data

Mar. 30, 2007 (JP) ..... 2007-091194

(51) Int. Cl.
*H01F 1/047* (2006.01)
*H01F 1/147* (2006.01)

(52) U.S. Cl. ..... 148/306; 148/100

(58) Field of Classification Search ..... None
See application file for complete search history.

(56) References Cited

FOREIGN PATENT DOCUMENTS

| | | | |
|---|---|---|---|
| JP | 11-12698 | A | 1/1999 |
| JP | 2000-150219 | A | 5/2000 |
| JP | 2000-252107 | A | 9/2000 |
| JP | 2001-505344 | A | 4/2001 |
| WO | WO 00/60616 | * | 10/2000 |

* cited by examiner

*Primary Examiner*—John P Sheehan
(74) *Attorney, Agent, or Firm*—Sughrue Mion, PLLC

(57) ABSTRACT

An object of the present invention is to solve the problem in hot workability caused by Cu aggregation and provide semi-hard magnetic materials having good magnetic properties, bias materials for magnetic markers, magnetic markers and production methods of bias materials for magnetic markers. The present invention provides a semi-hard magnetic material including 2.0%≦Cu≦10.0% and 0.1%≦Nb≦5.0% by mass %, the balance being Fe and inevitable impurities, and having a microstructure in which Cu phase and an intermetallic compound of Fe and Nb are dispersed. The semi-hard magnetic material of the present invention is suitable as bias materials for magnetic markers. Furthermore, the bias materials for magnetic markers can be formed by disposing bias materials for magnetic markers mentioned above so that a bias magnetic field may be applied to a magnetostrictive element for a magnetic marker.

9 Claims, 6 Drawing Sheets

SEMI-HARD MAGNETIC MATERIAL, BIAS MATERIAL FOR MAGNETIC MARKER, MAGNETIC MARKER AND PRODUCTION METHOD OF BIAS MATERIAL FOR MAGNETIC MARKER

This application claims priority from Japanese Patent Application No. 2007-091194, filed on Mar. 30, 2007, the disclosure of which is incorporated herein by reference in its entirety.

BACKGROUND OF THE INVENTION

The present invention relates to semi-hard magnetic materials in which both magnetized state functioning as a magnet and demagnetized state having substantially no magnetism can be used, bias materials for magnetic markers, magnetic markers which use the bias materials for magnetic marker, and production methods of bias materials for magnetic markers.

A semi-hard magnetic material is a material having a middle coercive force between a so-called permanent magnet also called hard magnetic material and a soft magnetic material. The semi-hard magnetic material shows soft magnetism in the matrix having magnetism by itself but by dispersing a nonmagnetic material therein so that the dispersed nonmagnetic material functions as obstacles against domain wall displacement when a magnetic field is applied from the outside, the coercive force thereof can be adjusted by the form and amount of the dispersed materials.

The semi-hard magnetic material is a material which can be used by changing between the two states of the magnetized state and the demagnetized state as stated above. Therefore, it has been used for switching devices for changing the direction of electric current, actuators and shutters which drive and/or control flow, sensing parts, etc.

In late years, electronic monitoring systems comprising attaching a magnetic label and detecting the label as a marker have been suggested for the purpose of theft prevention, recognition of article flow and kind of article, and so on. These systems are based on a mechanism consisting of resonantly oscillating a magnetostrictive element made of a certain amorphous metal in an alternating magnetic field, thereby changing the magnetic field and detecting the change by a pick-up coil to activate alarm.

An element which applies a bias magnetic field to a magnetostrictive element is called a bias element. Markers are attached to articles in the store in the state in which a semi-hard magnetic material is magnetized. When a price for an article is paid, an attenuating magnetic field, which decreases in the absolute value while repeatedly reversing the direction thereof, is applied from the outside of the marker, whereby the magnetic force of the bias element is reduced to equal to or less than the magnetic force in the fully magnetized state and the resonance of the magnetostrictive element is decreased, which inactivates the marker so that the alarm may not be activated.

When a semi-hard magnetic material is used for a magnetic marker, for example, the coercive force thereof must not be too small since the state of the bias element must not be changed by a magnetic field inadvertently applied from the outside. In the meantime, it is important to have an appropriate coercive force since inactivation becomes difficult if the coercive force is too large. Therefore, as materials of semi-hard magnetic materials which can have such an appropriate coercive force, the present inventors have proposed Fe—Cu group semi-hard magnetic materials (JP-A-11-12698).

The Fe—Cu group semi-hard magnetic materials of JP-A-11-12698 contain a large amount of Cu in Fe, and Cu, which is a nonmagnetic material, is finely deposited to increase the number of obstacles against the domain wall displacement thereby increasing the coercive force. JP-A-11-12698 also discloses a technique to disperse carbides such as those of Nb in addition to fine precipitation of Cu. It was supposed in JP-A-11-12698 that, when used as bias elements for magnetic markers, around 10 to 20% by mass % of Cu was necessary to obtain a coercive force of around 1600 to 2000 A/m which was considered to be suitable in bias elements.

However, there was a large difference between the solidification temperatures of Fe and Cu in the Fe—Cu alloy of JP-A-11-12698 and therefore, it was difficult to obtain a uniform structure by melt preparation method in which the alloy was molten and poured in a mold to be solidified since solidification of Cu delayed in the ingot casting. That is, macroscopically, Cu is segregated in the core of the ingot and microscopically, Cu aggregate in the grain boundary with Fe which constitutes a matrix.

Accordingly, the present inventors have proposed hot isostatic press method using powders (hereinbelow referred to as powder HIP method) as a realistic approach to finely disperse a large amount of Cu in Fe and obtain a uniform structure, which was difficult by melt preparation method (JP-A-11-12698). Here, the powder HIP method is a method to obtain uniform materials by using alloy powders obtained by a quenching method and filling the powders in a can, and compact pressurizing the same.

This powder HIP method is a method to finely disperse Cu in Fe and thereby obtaining a uniform structure by compound effect of Cu and various additional elements such as Mo and W by adding the various elements in a powder state.

Besides, the present inventors have suggested a laminating rolling method (JP-A-2000-150219) as another approach to let disperse Cu finely dispersed in Fe. The laminating rolling method disclosed in JP-A-2000-150219 is a method comprising alternately laminating a layer A mainly composed of Fe and a layer B mainly composed of Cu group non-magnetic metal to obtain a laminate, subjecting the laminate to heating and plastic working thereby particularly dividing the layer B having a low melting temperature to obtain a uniform material.

It is undeniable that the HIP method and the laminating rolling method disclosed in JP-A-11-12698 and JP-A-2000-150219 are high-cost production methods as compared with ordinary melt preparation method since the powders and plates or foils used as raw materials in themselves are costly and a number of steps are needed to obtain materials from the raw materials. In order to produce Fe—Cu group semi-hard magnetic materials industrially and inexpensively, industrial scale-up is effective and melt preparation method is the most excellent, and it is desirable to perform production by producing ingots as large as possible.

However, since the melting point of Cu is lower than that of Fe, aggregate region of Cu becomes more fluid (or liquefied) particularly at the time of hot processing in the melt preparation method, and cracks tend to occur from the aggregate region of Cu leading to deterioration of hot workability. Particularly, materials containing Cu in a content of 10.0% or more by mass % have a problem that they are remarkably poor in hot workability and difficult to be used in melt preparation method although the method is suitable for mass production. Therefore, it was preferable to reduce the Cu content as much as possible, but there was caused a problem that coercive force decreases when the Cu content is reduced.

An object of the present invention is to solve the problem in hot workability caused by Cu and provide semi-hard magnetic materials having high coercive force with less Cu content than conventional materials, bias materials for magnetic markers, magnetic markers and production methods of bias materials for magnetic markers.

SUMMARY OF THE INVENTION

The present inventors have conducted intensive studies so as to attain a desired high coercive force without deteriorating hot workability in Fe—Cu semi-hard magnetic materials. As a result, the present inventors have found that high coercive force can be attained due to nonmagnetic phases including uniformly and finely dispersed Cu phase and an intermetallic compound of Fe and Nb by adding a specified range of Nb to a Fe—Cu alloy to which Cu has been added in such a predetermined amount that Cu does not exist as a single phase but dissolves in the Fe matrix at hot working temperature, in which system, hot workability is not deteriorated even when melt preparation method is applied. Thus the present invention has been achieved.

That is, the present invention is semi-hard magnetic materials including 2.0%≦Cu≦10.0% and 0.1%≦Nb≦5.0% by mass %, the balance being Fe and inevitable impurities, and having a microstructure in which Cu phase and an intermetallic compound of Fe and Nb are dispersed.

The semi-hard magnetic material of the present invention preferably includes 3.0%≦Cu≦7.5% and 0.5%≦Nb≦3.0% by mass %.

In the semi-hard magnetic material of the present invention, the impurities, C, Si, Mn, P, S, Al, N and O are preferably controlled to C≦0.02%, Si≦0.50%, Mn≦0.60%, P≦0.05%, S≦0.02%, Al≦0.05%, N≦0.05% and O≦0.05% by mass %.

In addition, it is preferable that the average equivalent circle diameter of the intermetallic compound of Fe and Nb dispersed in a matrix is not more than 3 μm by the sectional microstructure observation of the semi-hard magnetic material of the present invention.

In addition, the semi-hard magnetic material of the present invention preferably has a coercive force Hc not less than 1600 A/m.

The semi-hard magnetic material of the present invention is suitable as bias materials for magnetic markers.

Further, the bias materials for magnetic markers of the present invention are made flatten or made into lines by plastic working, and the thickness t is preferably in a range of 10 μm≦t≦500 μm.

Furthermore, magnetic markers can be formed by disposing bias materials for magnetic markers mentioned above so that a bias magnetic field may be applied to a magnetostrictive element for a magnetic marker.

In addition, the bias materials for magnetic markers of the present invention can be obtained by making a melt prepared material including 2.0%≦Cu≦10.0% and 0.1%≦Nb≦5.0% by mass %, the balance being Fe and inevitable impurities, into flat plates or lines.

According to the present invention, hot workability in the melt prepared materials of Fe—Cu semi-hard magnetic materials can be improved drastically. Besides, it is an indispensable technology for providing a semi-hard magnetic material having high coercive force due to nonmagnetic phases including uniformly and finely dispersed Cu phase and an intermetallic compound of Fe and Nb, bias materials for magnetic markers and magnetic markers with low cost.

DESCRIPTION OF REFERENCE NUMERALS

Figure 1:
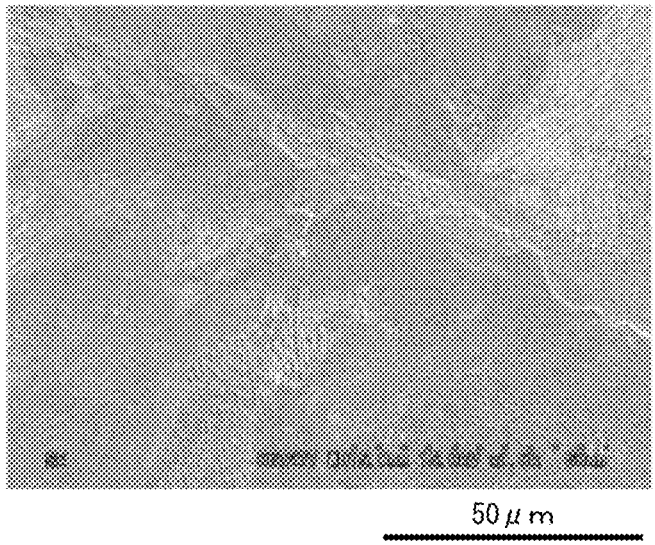
FIG. 1 is a photograph of the sectional microstructure with a scanning electron microscope showing an example of the present invention after vacuum melting.

1. Bias material; 2. Pack; 3. Magnetostrictive element; 4. Case

DETAILED DESCRIPTION OF THE INVENTION

The important characteristic of the present invention is to add Cu and Nb in contents of specified range to an Fe—Cu semi-hard magnetic material as stated above.

The present invention can drastically improve deterioration of the hot workability which is caused by hot shortness of Cu by adjusting the specified content of Cu dissolved in the Fe matrix equal to or below 10 mass % so that Cu does not exist as an independent phase at hot working temperature. In addition, the present invention succeeded in ultrafinely dispersing nonmagnetic phases of Cu phase and an intermetallic compound of Fe and Nb in a matrix having magnetism, a combination which has not been known conventionally, through interaction of Cu and Nb in a solidified state after the ingot making in melt preparation method. This approach has enabled stable production of Fe—Cu semi-hard magnetic materials having high coercive force by ultrafine dispersion of nonmagnetic phases which hinders the domain wall displacement in the semi-hard magnetic material of the present invention.

The Cu content can be changed in the semi-hard magnetic materials of the present invention in accordance with a coercive force demanded depending upon respective use. When the Cu content is too small, coercive force of 1600 A/m or more cannot be attained, and therefore the content of Cu is preferably 2.0% or more by mass %. More preferably it is 3.0% or more by mass %.

When the Cu content is too large, Cu aggregates in the core of an ingot and grain boundary with Fe like conventional melt prepared materials and the Cu content is preferably not more than 10.0% by mass %, and more preferably not more than 7.5% by mass %.

When the Nb content contained in the semi-hard magnetic material of the present invention is too small, sufficient effects cannot be attained, and therefore the content of Nb is preferably 0.1% or more by mass %. More preferably it is 0.5% or more by mass %.

On the other hand, when the Nb content is too large, workability is deteriorated, and therefore addition of not more than 5.0% by mass % is preferable. More preferably it is not more than 3.0% by mass %.

In order to suppress deterioration of workability in hot and cold processing, C, Si, Mn, P, S, Al, N and O as impurities are preferably controlled to C≦0.02%, Si≦0.50%, Mn≦0.60%, P≦0.05%, S≦0.02%, Al≦0.05%, N≦0.05% and O≦0.05% by mass % in the semi-hard magnetic material of the present invention.

It is preferable that the average equivalent circle diameter of the intermetallic compound of Fe and Nb dispersed in a matrix is not more than 3 μm in the sectional microstructure of the semi-hard magnetic material of the present invention. This is because a large coercive force can be obtained with less Cu content since when the intermetallic compound of Fe and Nb are finely dispersed in the matrix each of the particles can be obstacles against the domain wall displacement. Here, the average equivalent circle diameter of the intermetallic compound of Fe and Nb means an average diameter of circles when the intermetallic compound of Fe and Nb in the sectional micro-observation of the semi-hard magnetic material is approximated by a circle.

It is preferable that the semi-hard magnetic material of the present invention has a coercive force not less than 1600 A/m. An effect that it is hard to be demagnetized by an inadvertent outside magnetic field is brought about by a coercive force not less than 1600 A/m. In addition, the semi-hard magnetic material of the present invention can be changed from a completely magnetized state to a demagnetized state by applying an attenuating magnetic field, which gradually decreases in the absolute value while repeatedly reversing the direction of the magnetic field. Such magnetic properties are properties desirable for relay circuit members, switching devices, actuators and particularly suitable for bias materials of the magnetic markers.

The semi-hard magnetic material of the present invention uses a Cu phase and an intermetallic compound of Fe and Nb as nonmagnetic phases. This Cu phase and intermetallic compound of Fe and Nb hardly dissolve in a matrix at room temperature, and therefore they have an effect to maintain the magnetic flux density which the matrix originally has. The intensity of the magnetic field which a magnetic material generates in the peripherals is a production of the magnetic flux density of the material and the cross section thereof. Accordingly, when a magnetic field of a certain intensity is to be generated using a magnetic material as a member thereof, the more magnetic flux density of the material, the less the cross section will suffice, and therefore such a material is very effective for reducing the size and/or thickness of the member. Therefore, it is very effective, for example, when used as a bias element for a magnetic marker since it is neither conspicuous nor impeditive when attached to an article.

The bias materials for magnetic markers of the present invention can be used as a magnetic marker by combining with a magnetostrictive element. The semi-hard magnetic material of the present invention is made flat into a foil, for example, by rolling processing, and excised in a size sufficient to generate a desired magnetic field and used as a bias material. The bias material is sandwiched with, for example, a resin pack to form a bias element. A magnetostrictive element is disposed closed to the bias element and put in a resin case, for example, to form a magnetic marker.

The thickness of the bias materials for magnetic markers of the present invention is preferably not less than 10 μm. When it is too thin, handling in a step for assembling a marker becomes difficult.

On the other hand, when the thickness is too large, the bias magnetic filed is not suitable for miniaturizing the magnetic marker, and a thickness not more than 500 μm is preferable.

The bias materials for magnetic markers of the present invention can be used so that two or more sheets of thin bias materials are overlaid and attached or a flat foil can be rolled and used.

It is preferable that the bias materials for magnetic markers of the present invention are subjected to hot and cold plastic working to form aggregated structure of the matrix.

The aggregated structure of material is in a condition in which crystals constituting the material are disposed in the same direction and the magnetic domains present therein have the same direction and each magnetic domain behaves in the same way when a magnetic field is applied from the outside. That is, as the intensity of the magnetic field applied from the outside is gradually increased, the domain walls moves all at once when the intensity becomes close to the coercive force of the material. In other words, switching from a demagnetized state to a magnetized state does not slowly occur but occurs instantly, and therefore, it is extremely suitable for use in applications for switching ON and OFF. It is particularly suitable for a bias element for magnetic markers.

The production method of bias materials for magnetic markers of the present invention preferably comprises hot plastic working with a large deformability at an early stage of the processing step, when the thickness of the material is large and working is conducted with a large working ratio. When strain is accumulated inside the material at this time and deformability deteriorates, the strain may be removed by heat-treatment (annealing) at an intermediate step. It is also preferable in the production method of bias materials for magnetic markers of the present invention to repeat cold plastic working to conduct transformation in the same direction at a later stage of the processing step to obtain an aggregate structure of the matrix inside the materials.

The bias materials for magnetic markers of the present invention can be obtained by also worked into a thin line, for example, by drawing.

In the conventional production method of semi-hard magnetic materials containing a large amount of Cu, large nonmagnetic phases are present and accordingly, a technique was taken in which the matrix was once molten by a heat-treatment at the high temperature and fine precipitates are formed by a heat-treatment following a plastic working. However, the structure is sufficiently fine at the solidified stage in the semi-hard magnetic material of the present invention and therefore, heat-treatment at high temperature for forming a solid solution can be omitted. On this account, energy for heat-treatment and time for cooling can be saved and thus there is a large effect in the reduction of the production cost.

DESCRIPTION OF PREFERRED EMBODIMENTS

Raw materials adjusted to the mass ratio in the composition shown in Table 1 were molten in vacuum and cast into a mold to obtain an ingot of a melt prepared material.

Figure 2:
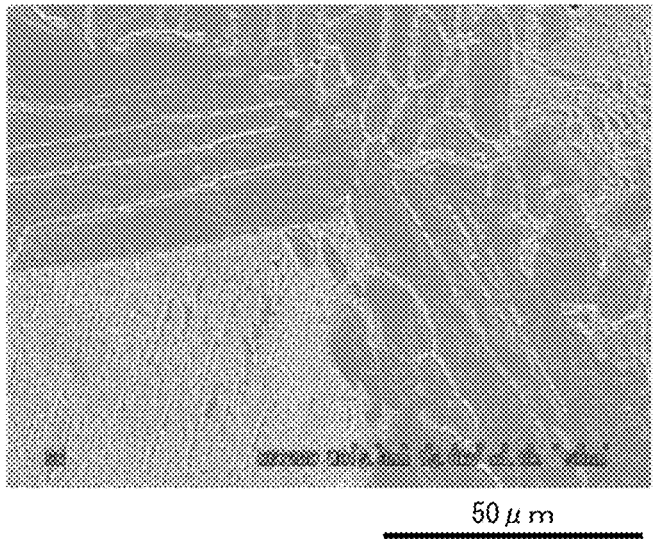
FIG. 2 is a photograph of the sectional microstructure with a scanning electron microscope showing an example of the present invention after vacuum melting.
Figure 3:
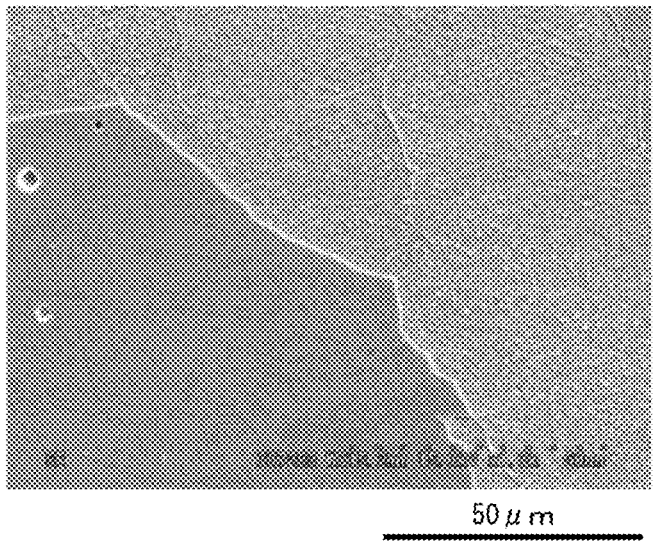
FIG. 3 is a photograph of the sectional microstructure with a scanning electron microscope showing an example of a comparative example after vacuum melting.

The section of the ingot of the example of the present invention and that of a comparative example after subjected to vacuum melting (solidification) were observed with a scanning electron microscope. Photographs of the microstructure of Test Example 1 (example of the present invention), Test Example 4 (example of the present invention) and Test Example 18 (comparative example) containing no Nb are shown in FIG. 1, FIG. 2 and FIG. 3 respectively. The white region in the microstructure is a Cu phase.

It can be confirmed from FIG. 1 and FIG. 2 that nonmagnetic phases of the Cu phase and the intermetallic compound of Fe and Nb are uniformly and finely dispersed from a solidification stage in the semi-hard magnetic material of the present invention. $Fe_2Nb$ was detected when this intermetallic compound of Fe and Nb was subjected to X-ray diffraction analysis.

On the other hand, Cu phase was not uniformly and finely dispersed at a solidification stage in FIG. 3 which shows a comparative example, and therefore it was presumed that Nb had an effect of fine dispersing of the Cu phase.

The obtained ingots were heated at 900° C. and subjected to extend forging, and after that, heated and hot rolled at 850 to 1050° C. for each composition shown in Table 1 and heated at 800 to 950° C. and heat-treated for removing strain. Subsequently, surface oxide films were removed by grinder processing and subjected to cold-rolling to a thickness of 0.1 to 0.2 mm and semi-hard magnetic materials were obtained.

Workability was evaluated with regard to two steps of hot extend forging and rolling. The degree of cracking was shown in the two steps of hot extend forging and rolling, specifically, good results without cracking were indicated by ○, results with some cracking were indicated by Δ and results with too severe cracking to proceed to the next step were indicated by x.

Test Examples 1 to 12 are examples according to the present invention in which Cu and Nb are added as shown in Table 1, and no occurrence of flaw due to working was recognized in either step of extend forging and hot rolling, no problems occurred in removing the surface oxide films, and each of these samples were able to be extended to a thickness of 0.1 to 0.2 mm by cold rolling. It was confirmed that the weight in the final shape was not less than 80% of the ingot weight, and thus the yield was also excellent.

On the other hand, Test Example 13 is a comparative example in which 10% of Cu and 5.3% of Nb by mass % were contained and some cracking occurred by extend forging and hot rolling on the rest part caused cracking. This is supposed to be resulted from deterioration in workability of the material in itself, which in turn is caused by excessive addition of Nb.

Test Example 14 is a comparative example in which 4.9% of Cu and 10% of Nb by mass % were contained and severe cracking occurred by extend forging. This is supposed to be resulted from deterioration in workability of the material in itself, which in turn is caused by excessive addition of Nb.

Test Examples 15 to 22 are comparative examples of Fe—Cu melt prepared materials in which no Nb was added. Test Examples 15 to 19 in which addition amount of Cu is not sufficient caused no flaw or cracking in either step of extend forging and hot rolling, and there was no problem in the production.

Test Examples 20 to 22 in which 9.0% or more of Cu by mass % was contained caused significant flaw or cracking by extend forging and hot rolling, and the weight in the final shape was less than 80%, partially around 50% of the ingot weight, and thus the yield was significantly poor.

Test Example 23 is a comparative example of melt prepared material in which no Cu was added and only Nb was added in a content of 2.8% by mass %, and no flaw or cracking was recognized in either step of extend forging and hot rolling.

Test Example 24 is a comparative example of melt prepared material in which Zr in place of Nb was added in a content of 0.8% by mass %, and cracking occurred during hot rolling but the intact part was able to proceed to the next step and extended to a thickness of 0.1 to 0.2 mm.

Test Example 25 in which 5.2% by mass % of Zr was added caused too severe cracking during extend forging to proceed to the next step.

Test Examples 26 and 27 are comparative examples of melt prepared material in which Ti was added in place of Nb. In both of Test Example 26 in which 1.1% by mass % of Ti was added and Test Example 27 in which 2.0% by mass % of Ti was added, extend forging and hot rolling were possible. However, surface oxide film was too hard to be removed by acid wash and with a grinder, it was not possible to advance to the cold-rolling process.

Next, semi-hard magnetic materials after cold rolled to 0.1 to 0.2 mm were observed with a scanning electron microscope. All of the structure observation was performed after corroded with an agent solution. Photographs of the section microstructure of Test Example 1 (example of the present invention), Test Example 4 (example of the present invention) and Test Example 18 (comparative example) are shown in FIG. 4, FIG. 5 and FIG. 6 respectively.

Figure 4:
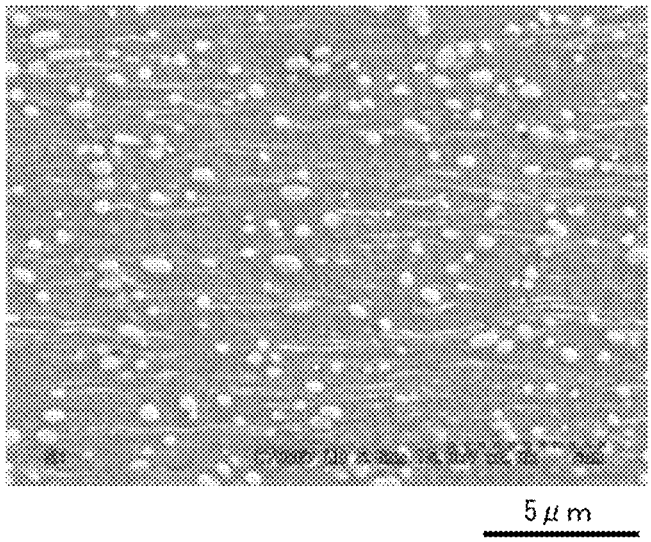
FIG. 4 is a photograph of the sectional microstructure with a scanning electron microscope showing an example of the present invention after cold rolling.
Figure 5:
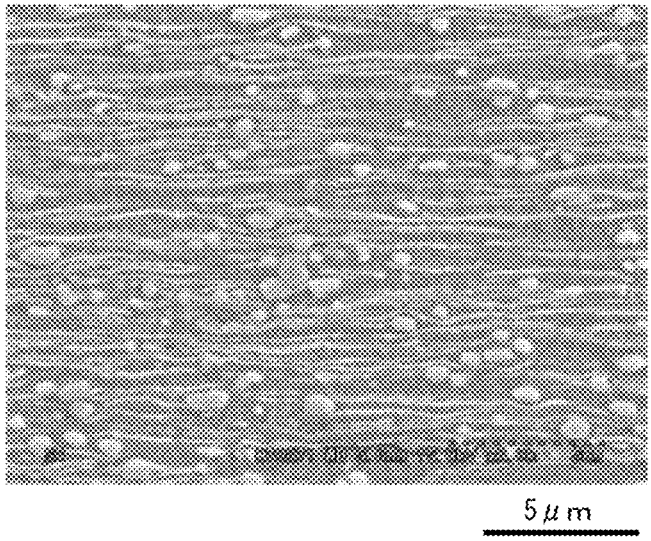
FIG. 5 is a photograph of the sectional microstructure with a scanning electron microscope showing an example of the present invention after cold rolling.

It has been confirmed from FIG. 4 and FIG. 5 that nonmagnetic phases of a fibrous Cu phase and a granular intermetallic compound of Fe and Nb are finely dispersed in the Fe matrix in the semi-hard magnetic material of the present invention.

Figure 6:
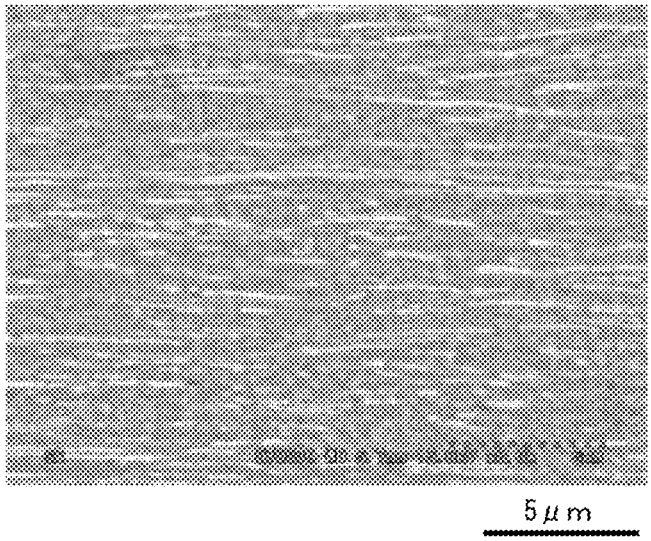
FIG. 6 is a photograph of the sectional microstructure with a scanning electron microscope showing an example of a comparative example after cold rolling.

On the other hand, it has been confirmed in FIG. 6, which is a comparative example, that only Cu phase is dispersed in the Fe matrix while extended in the rolling direction.

TABLE 1

| | Ingredient (mass %) | | | | | | | | | | | |
|---|---|---|---|---|---|---|---|---|---|---|---|---|
| No. | Cu | Nb | Zr | Ti | C | Si | Mn | P | S | Al | N | O |
| Test Example 1 | 2.6 | 2.8 | — | — | 0.001 | 0.22 | 0.29 | 0.008 | 0.003 | 0.017 | 0.002 | 0.005 |
| Test Example 2 | 5.0 | 0.9 | — | — | 0.004 | 0.19 | 0.30 | 0.010 | 0.003 | 0.002 | 0.010 | 0.013 |
| Test Example 3 | 5.0 | 2.0 | — | — | 0.001 | 0.20 | 0.28 | 0.008 | 0.003 | 0.007 | 0.001 | 0.003 |
| Test Example 4 | 5.0 | 2.7 | — | — | 0.001 | 0.22 | 0.30 | 0.007 | 0.002 | 0.009 | 0.001 | 0.003 |

TABLE 1-continued

| | | | | | | | | | | | | |
|---|---|---|---|---|---|---|---|---|---|---|---|---|
| Test Example 5 | 5.0 | 3.1 | — | — | 0.002 | 0.21 | 0.29 | 0.008 | 0.003 | 0.001 | 0.002 | 0.005 |
| Test Example 6 | 5.0 | 4.9 | — | — | 0.005 | 0.14 | 0.24 | 0.008 | 0.002 | 0.013 | 0.001 | 0.005 |
| Test Example 7 | 6.0 | 1.5 | — | — | 0.001 | 0.21 | 0.29 | 0.004 | 0.002 | 0.003 | 0.001 | 0.003 |
| Test Example 8 | 6.1 | 2.1 | — | — | 0.003 | 0.19 | 0.28 | 0.006 | 0.001 | 0.022 | 0.001 | 0.001 |
| Test Example 9 | 7.0 | 1.0 | — | — | 0.001 | 0.21 | 0.29 | 0.005 | 0.002 | 0.009 | 0.001 | 0.002 |
| Test Example 10 | 7.0 | 1.6 | — | — | 0.001 | 0.19 | 0.29 | 0.007 | 0.001 | 0.010 | 0.001 | 0.003 |
| Test Example 11 | 6.9 | 2.1 | — | — | 0.003 | 0.18 | 0.28 | 0.006 | 0.002 | 0.023 | 0.001 | 0.001 |
| Test Example 12 | 7.5 | 2.7 | — | — | 0.004 | 0.26 | 0.30 | 0.009 | 0.004 | 0.014 | 0.002 | 0.003 |
| Test Example 13 | 10.0 | 5.3 | — | — | 0.006 | 0.20 | 0.30 | 0.010 | 0.003 | 0.005 | 0.001 | 0.006 |
| Test Example 14 | 4.9 | 10.0 | — | — | 0.003 | 0.13 | 0.22 | 0.007 | 0.002 | 0.001 | 0.004 | 0.020 |
| Test Example 15 | 1.5 | — | — | — | 0.005 | 0.21 | 0.28 | 0.008 | 0.003 | 0.016 | 0.001 | 0.005 |
| Test Example 16 | 3.0 | — | — | — | 0.001 | 0.19 | 0.29 | 0.008 | 0.004 | 0.007 | 0.003 | 0.003 |
| Test Example 17 | 4.0 | — | — | — | 0.001 | 0.21 | 0.23 | 0.007 | 0.002 | 0.008 | 0.001 | 0.007 |
| Test Example 18 | 5.1 | — | — | — | 0.004 | 0.21 | 0.29 | 0.007 | 0.002 | 0.002 | 0.001 | 0.008 |
| Test Example 19 | 7.0 | — | — | — | 0.002 | 0.20 | 0.27 | 0.010 | 0.003 | 0.009 | 0.003 | 0.003 |
| Test Example 20 | 9.0 | — | — | — | 0.001 | 0.20 | 0.29 | 0.008 | 0.003 | 0.010 | 0.001 | 0.003 |
| Test Example 21 | 9.5 | — | — | — | 0.002 | 0.21 | 0.29 | 0.010 | 0.003 | 0.009 | 0.001 | 0.005 |
| Test Example 22 | 15.0 | — | — | — | 0.009 | 0.19 | 0.20 | 0.007 | 0.001 | 0.008 | 0.001 | 0.003 |
| Test Example 23 | — | 2.8 | — | — | 0.001 | 0.22 | 0.29 | 0.003 | 0.004 | 0.002 | 0.003 | 0.007 |
| Test Example 24 | 4.9 | — | 0.8 | — | 0.007 | 0.21 | 0.30 | 0.010 | 0.003 | 0.020 | 0.001 | 0.005 |
| Test Example 25 | 5.1 | — | 5.2 | — | 0.006 | 0.16 | 0.28 | 0.011 | 0.002 | 0.026 | 0.001 | 0.003 |
| Test Example 26 | 5.0 | — | — | 1.1 | 0.006 | 0.20 | 0.29 | 0.010 | 0.003 | 0.020 | 0.001 | 0.005 |
| Test Example 27 | 5.0 | — | — | 2.0 | 0.005 | 0.19 | 0.29 | 0.010 | 0.003 | 0.022 | 0.001 | 0.004 |

| | | Hot Step | | |
|---|---|---|---|---|
| No. | Production method | Extend Forging | Hot Rolling | Note |
| Test Example 1 | Melt Production Method | ○ | ○ | Example of the present invention |
| Test Example 2 | Melt Production Method | ○ | ○ | Example of the present invention |
| Test Example 3 | Melt Production Method | ○ | ○ | Example of the present invention |
| Test Example 4 | Melt Production Method | ○ | ○ | Example of the present invention |
| Test Example 5 | Melt Production Method | ○ | ○ | Example of the present invention |
| Test Example 6 | Melt Production Method | ○ | ○ | Example of the present invention |
| Test Example 7 | Melt Production Method | ○ | ○ | Example of the present invention |
| Test Example 8 | Melt Production Method | ○ | ○ | Example of the present invention |
| Test Example 9 | Melt Production Method | ○ | ○ | Example of the present invention |
| Test Example 10 | Melt Production Method | ○ | ○ | Example of the present invention |
| Test Example 11 | Melt Production Method | ○ | ○ | Example of the present invention |
| Test Example 12 | Melt Production Method | ○ | ○ | Example of the present invention |
| Test Example 13 | Melt Production Method | Δ | X | Comparative Example |
| Test Example 14 | Melt Production Method | X | — | Comparative Example |
| Test Example 15 | Melt Production Method | ○ | ○ | Comparative Example |
| Test Example 16 | Melt Production Method | ○ | ○ | Comparative Example |
| Test Example 17 | Melt Production Method | ○ | ○ | Comparative Example |
| Test Example 18 | Melt Production Method | ○ | ○ | Comparative Example |
| Test Example 19 | Melt Production Method | ○ | ○ | Comparative Example |
| Test Example 20 | Melt Production Method | Δ | ○ | Comparative Example |
| Test Example 21 | Melt Production Method | Δ | ○ | Comparative Example |
| Test Example 22 | Melt Production Method | Δ | Δ | Comparative Example |
| Test Example 23 | Melt Production Method | ○ | ○ | Comparative Example |
| Test Example 24 | Melt Production Method | ○ | Δ | Comparative Example |
| Test Example 25 | Melt Production Method | X | — | Comparative Example |
| Test Example 26 | Melt Production Method | ○ | ○ | Comparative Example |
| Test Example 27 | Melt Production Method | ○ | ○ | Comparative Example |

Next, aging treatment of 450 to 550° C. for each composition shown in Table 1 was performed assuming that the obtained semi-hard magnetic materials were used as bias materials for magnetic markers. Magnetic properties of the obtained semi-hard magnetic materials were measured by York method. The results of the measurement are shown in Table 2.

Here, the York method is a method for determining the magnetic field caused by a semi-hard magnetic material, which comprises inserting a semi-hard magnetic material processed to a thin sample into a coil around which the primary wire is wound, applying an external magnetic field to the semi-hard magnetic material by allowing an electric current to pass through this primary wire and detecting a change in the electric current passing through the secondary wire which is wound around a secondary coil, part of which is the semi-hard magnetic material.

As for the magnetic properties, coercive force Hc (unit, A/m) important for bias materials for magnetic markers were measured. The residual magnetic flux density Br (unit, T) and Br/B8000 (no unit) were also measured. Here, Br/B8000 is a value obtained by dividing the residual magnetic flux density by B8000, which is a magnetic flux density when an external magnetic field of 8000 A/m is applied on the material, and as the value is closer to 1, the semi-hard magnetic material is less apt to be demagnetized by an external magnetic field inadvertently applied and therefore the material is more suitable as a bias material for a magnetic marker.

Coercive force sufficient for use in bias materials for magnetic markers was obtained in Test Example 1 to 12 which were examples of the present invention. They have a Br of more than 1.0 T as well and can attain a necessary bias magnetic field when formed in a small sized and thin member, and therefore, they are suitable as bias materials for magnetic markers. Furthermore, they have a Br/B8000 value exceeding 0.8 and they are less apt to be demagnetized by an external magnetic field inadvertently applied and thus it has been confirmed that the materials are suitable as bias materials for magnetic markers.

In addition, it has been confirmed that high coercive force can be obtained with a small Cu content as compared with Fe—Cu semi-hard magnetic materials (melt prepared materials) of Test Examples 15 to 19 (comparative examples) in which no Nb is added.

Furthermore, the semi-hard magnetic materials mentioned above have sufficient coercive forces as a result of measuring the magnetic properties before subjected to the aging treatment, and thus it has been confirmed that the semi-hard magnetic material of the present invention can be used as bias materials for magnetic markers without subjecting to aging treatment.

On the other hand, it has been confirmed that Test Examples 15 to 19 (comparative examples) showed a coercive force of not more than 1300 A/m. Intact parts of Test Example 20 to 22 were processed at the next step and the magnetic properties thereof were measured, and it was found that they have sufficient coercive forces but they have little intact part after extend forging and that they are not practical.

It was also confirmed that Test Example 23 has a low coercive force as low as 1000 A/m.

Intact parts of Test Example 24 were processed at the next step and the magnetic properties thereof were measured, and it was found that they have increased coercive forces as compared with Test Example 18 without the addition of Zr but that the effect was smaller as compared with Test Example 2 of the present invention in which almost the same amount of Nb was added.

Next, the semi-hard magnetic materials after subjected to aging treatment were observed with a scanning electron microscope. All of the structure observation was performed after corroded with an agent solution. Photographs of the section microstructure observed with a scanning electron microscope of Test Example 1 (example of the present invention), Test Example 4 (example of the present invention) and Test Example 18 (comparative example) after subjected to cold rolling followed by aging treatment at 500° C. are shown in FIG. 7, FIG. 8 and FIG. 9, respectively.

Figure 7:
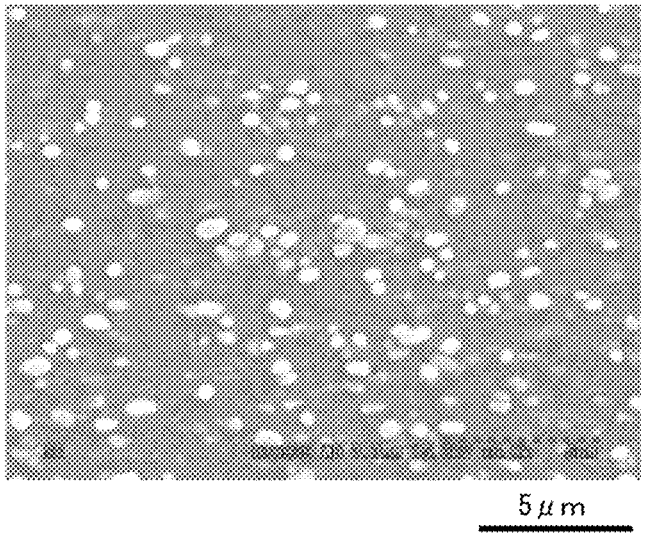
FIG. 7 is a photograph of the sectional microstructure with a scanning electron microscope showing an example of the present invention after aging treatment.
Figure 8:
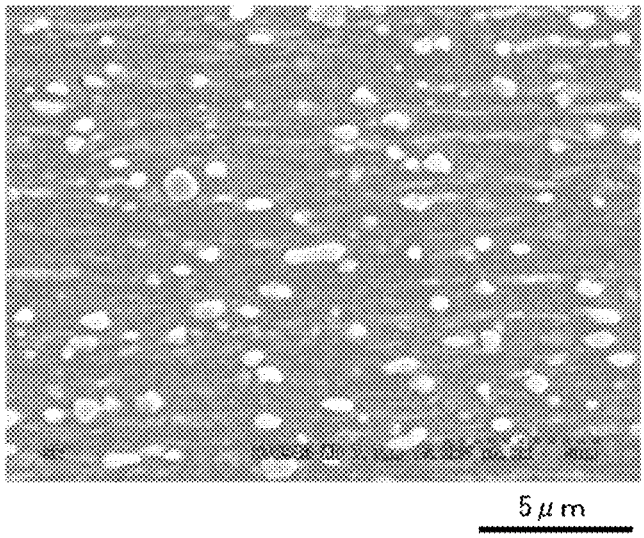
FIG. 8 is a photograph of the sectional microstructure with a scanning electron microscope showing an example of the present invention after aging treatment.

It has been confirmed from FIG. 7 and FIG. 8 that nonmagnetic phases of a fibrous or granular (scale-like) Cu phase and a granular intermetallic compound of Fe and Nb finely divided by the Fe matrix are finely dispersed in the semi-hard magnetic material of the present invention.

Figure 9:
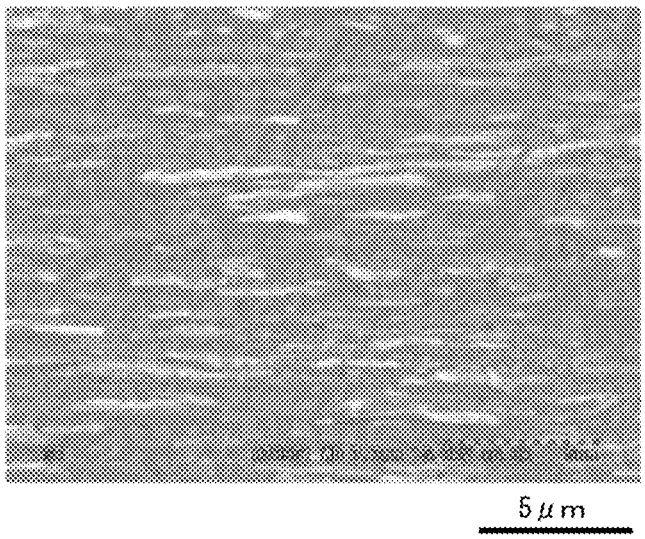
FIG. 9 is a photograph of the sectional microstructure with a scanning electron microscope showing an example of a comparative example after aging treatment.

On the other hand, it has been confirmed in FIG. 9, which is a comparative example, that only Cu phase is dispersed in the Fe matrix while extended in the rolling direction.

Figure 10:
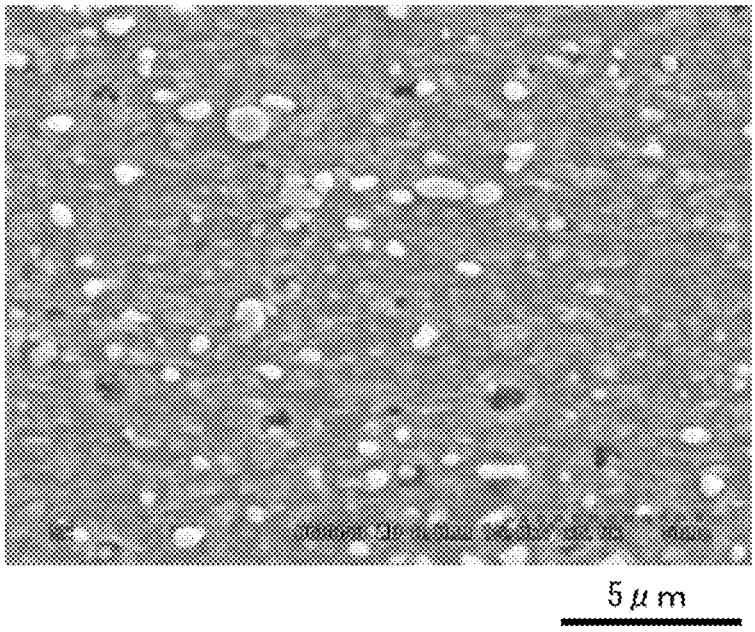
FIG. 10 is a photograph of the sectional microstructure with a scanning electron microscope showing an example of the present invention after aging treatment.

A photograph of the section microstructure observed with a scanning electron microscope of Test Example 4 (example of the present invention) after subjected to cold rolling followed by aging treatment at 525° C. is shown in FIG. 10. It has been confirmed from FIG. 10 that nonmagnetic phases of a granular (scale-like) Cu phase and a granular intermetallic compound of Fe and Nb are finely dispersed in the Fe matrix in the semi-hard magnetic material of the present invention. The average equivalent circle diameter of the intermetallic compound of Fe and Nb in the examples of the present invention is not more than 3 μm in either case as shown in each figure.

Figure 11:
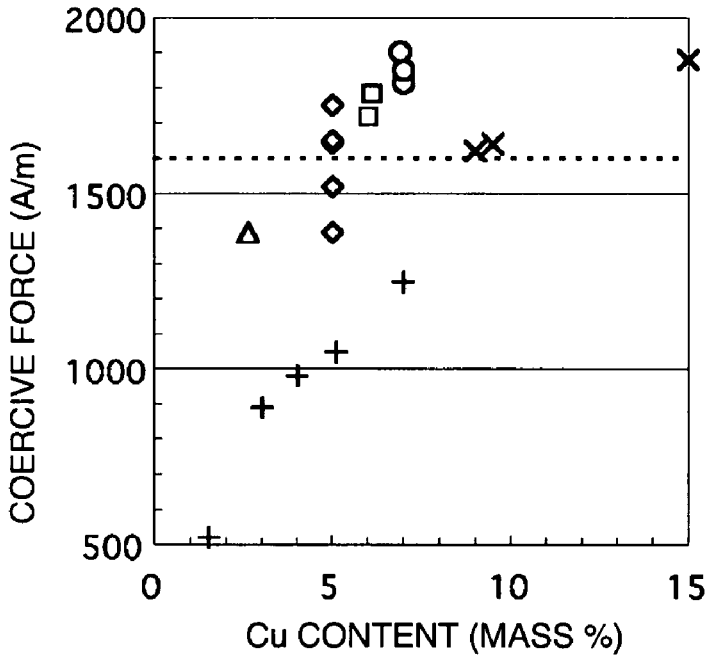
FIG. 11 is a graph showing the comparison of magnetic properties between the examples of the present invention and the comparative examples.

Magnetic properties of examples of the present invention and comparative examples are show in FIG. 11. The Cu content is taken as a horizontal axis and the coercive force is taken as a vertical axis. Test Examples 15 to 22 (comparative

TABLE 2

| | Magnetic Properties (with aging treatment) | | | Magnetic Properties (without aging treatment) | | | |
|---|---|---|---|---|---|---|---|
| No. | Hc[A/m] | Br[T] | Br/B8000 | Hc[A/m] | Br[T] | Br/B8000 | Note |
| Test Example 1 | 1389 | 1.45 | 0.86 | 1902 | 1.38 | 0.80 | Example of the present invention |
| Test Example 2 | 1390 | 1.40 | 0.85 | 1568 | 1.44 | 0.83 | Example of the present invention |
| Test Example 3 | 1520 | 1.38 | 0.85 | 1870 | 1.44 | 0.84 | Example of the present invention |
| Test Example 4 | 1643 | 1.44 | 0.87 | 1910 | 1.42 | 0.84 | Example of the present invention |
| Test Example 5 | 1650 | 1.35 | 0.85 | 1989 | 1.30 | 0081 | Example of the present invention |
| Test Example 6 | 1750 | 1.14 | 0.80 | 2149 | 0.92 | 0.65 | Example of the present invention |
| Test Example 7 | 1719 | 1.52 | 0.87 | 1822 | 1.51 | 0.86 | Example of the present invention |
| Test Example 8 | 1783 | 1.46 | 0.87 | 1942 | 1.47 | 0.86 | Example of the present invention |
| Test Example 9 | 1814 | 1.53 | 0.88 | 1739 | 1.53 | 0.86 | Example of the present invention |
| Test Example 10 | 1850 | 1.51 | 0.87 | 1862 | 1.50 | 0.86 | Example of the present invention |
| Test Example 11 | 1902 | 1.47 | 0.88 | 1993 | 1.49 | 0.87 | Example of the present invention |
| Test Example 12 | 1783 | 1.43 | 0.87 | 2080 | 1.40 | 0.85 | Example of the present invention |
| Test Example 13 | — | — | — | — | — | — | Comparative Example |
| Test Example 14 | — | — | — | — | — | — | Comparative Example |
| Test Example 15 | 520 | 1.71 | 0.88 | — | — | — | Comparative Example |
| Test Example 16 | 890 | 1.68 | 0.87 | — | — | — | Comparative Example |
| Test Example 17 | 980 | 1.67 | 0.88 | — | — | — | Comparative Example |
| Test Example 18 | 1050 | 1.49 | 0.86 | 1234 | 1.43 | 0.84 | Comparative Example |
| Test Example 19 | 1250 | 1.60 | 0.91 | — | — | — | Comparative Example |
| Test Example 20 | 1620 | 1.62 | 0.91 | — | — | — | Comparative Example |
| Test Example 21 | 1640 | 1.62 | 0.91 | — | — | — | Comparative Example |
| Test Example 22 | 1880 | 1.45 | 0.90 | — | — | — | Comparative Example |
| Test Example 23 | 975 | 1.44 | 0.84 | 1619 | 1.29 | 0.77 | Comparative Example |
| Test Example 24 | 1150 | 1.39 | 0.84 | 1432 | 1.38 | 0.82 | Comparative Example |
| Test Example 25 | — | — | — | — | — | — | Comparative Example |
| Test Example 26 | — | — | — | — | — | — | Comparative Example |
| Test Example 27 | — | — | — | — | — | — | Comparative Example |

examples) which are Fe—Cu semi-hard magnetic materials containing no Nb are indicated by + (among these, results with poor hot workability are indicated by x).

Here, Test Example 1, an example of the present invention, in which 2.6% by mass % of Cu and 2.8% by mass % of Nb are added to a Fe—Cu semi-hard magnetic material (melt prepared material) is indicated by Δ.

Test Examples 2 to 6 in which 5.0% by mass % of Cu and 0.9%, 2.0%, 2.7%, 3.1% and 4.9% by mass % of Nb are respectively added are indicated by ◇.

Test Example 7 in which 6.0% by mass % of Cu and 1.5% by mass % of Nb are added and Test Example 8 in which 6.1% by mass % of Cu and 2.1% by mass % of Nb are added are indicated by □.

Test Examples 9 and 10 in which 7.0% by mass % of Cu and 1.0% and 1.6% by mass % of Nb are added and Test Example 11 in which 6.9% by mass % of Cu and 2.1% by mass % of Nb are added are indicated by ○.

It can be understood that, due to the effect of the addition of Nb, desired high coercive forces can be obtained as compared with the comparative examples in which no Nb is added.

Figure 12:
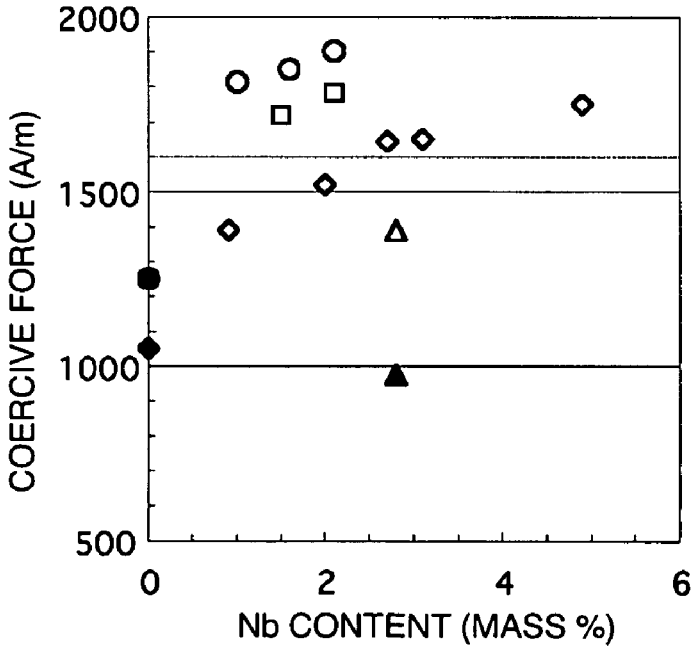
FIG. 12 is a graph showing the comparison of magnetic properties between the examples of the present invention and the comparative examples.

Magnetic properties of the present invention example and the comparative examples are shown in FIG. 12. The Nb content is taken as a horizontal axis and the coercive force is taken as a vertical axis. Among the comparative examples which are Fe—Cu semi-hard magnetic materials (melt prepared materials) containing no Nb, Test Example 18 in which 5.1% by mass % of Cu is added is indicated by ◆and Test Example 19 in which 7.0% by mass % of Cu is added is indicated by ●. In addition, as a comparative example containing no Cu, Test Example 23 in which 2.8% by mass % of Nb is added is indicated by ▲.

Further, in the same manner as FIG. 11, Test Example 1, an example of the present invention, in which 2.6% by mass % of Cu and 2.8% by mass % of Nb are added to a Fe—Cu semi-hard magnetic material (melt prepared material) is indicated by Δ.

Test Examples 2 to 6 in which 5.0% by mass % of Cu and 0.9%, 2.0%, 2.7%, 3.1% and 4.9% by mass % of Nb are respectively added are indicated by ◇.

Test Example 7 in which 6.0% by mass % of Cu and 1.5% by mass % of Nb are added and Test Example 8 in which 6.1% by mass % of Cu and 2.1% by mass % of Nb are added are indicated by □.

Test Examples 9 and 10 in which 7.0% by mass % of Cu and 1.0% and 1.6% by mass % of Nb are added and Test Example 11 in which 6.9% by mass % of Cu and 2.1% by mass % of Nb are added are indicated by ○.

It can be understood that, due to the effect of the addition of Nb, high coercive forces can be obtained in the semi-hard magnetic materials of the present invention as compared with the comparative examples in which no Nb is added.

In addition, higher coercive forces were obtained as compared with the comparative examples in which no Cu was added, and thus it can be understood that high coercive forces can be obtained by adding Nb in a specific range to Fe—Cu alloys in which a specific amount of Cu has been added.

Figure 13:
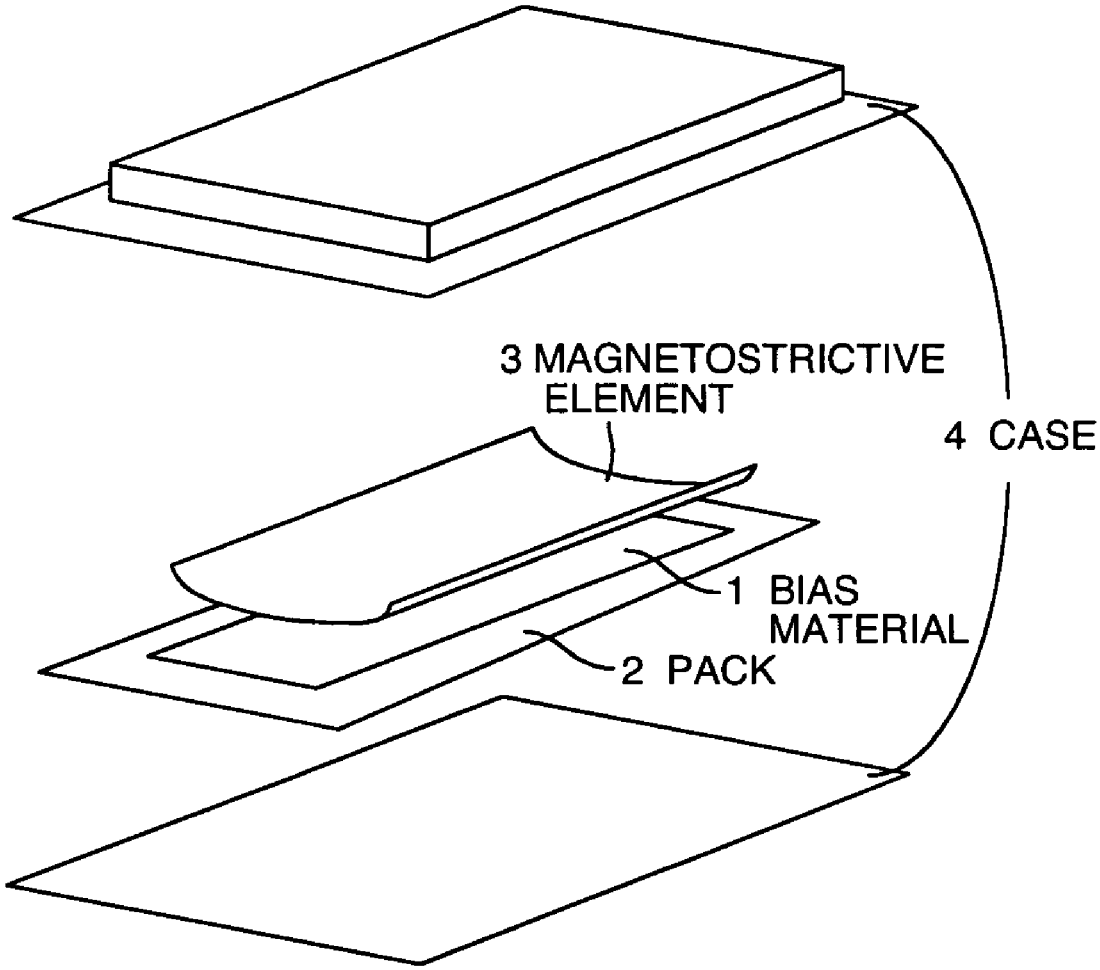
FIG. 13 illustrates an example of constitution when a semi-hard magnetic material of the present invention is used as a magnetic marker.

FIG. 13 illustrates an example of constitution when a semi-hard magnetic material of the present invention is used as a magnetic marker. The semi-hard magnetic material of the present invention is made flat into a thin piece by rolling processing and excised in such a size that it can generate a desired magnetic field to be a bias material 1. This is sandwiched between resin packs 2 to form a bias material and a magnetostrictive element 3 is closely disposed, and these are put in a resin case 4 and thus a magnetic marker can be formed.

The semi-hard magnetic material of the present invention can be used as relay circuit members, switching devices, actuators and particularly suitable for bias materials of the magnetic markers.

The invention claimed is:

1. A semi-hard magnetic material comprising 2.0%≦Cu≦10.0% and 0.5%≦Nb≦5.0% by mass %, the balance being Fe and inevitable impurities, and having a microstructure in which a Cu phase and an intermetallic compound of Fe and Nb are dispersed, wherein the impurities, C, Si, Mn, P, S, Al, N and O are controlled to C≦0.02%, Si≦0.50%, Mn≦0.60%, P≦0.05%, S≦0.02%, Al≦0.05%, N≦0.05% and O≦0.05% by mass %.

2. The semi-hard magnetic material according to claim 1 which comprises 3.0%≦Cu≦7.5% by mass %.

3. The semi-hard magnetic material according to claim 1 which comprises 0.5%≦Nb≦3.0% by mass %.

4. The semi-hard magnetic material according to claim 1 wherein the intermetallic compound of Fe and Nb dispersed in a matrix has an average equivalent circle diameter of not more than 3 μm by sectional microstructure observation.

5. The semi-hard magnetic material according to claim 1 having a coercive force Hc not less than 1600 A/m.

6. A bias material for a magnetic marker comprising a semi-hard magnetic material according to claim 1.

7. The bias material for a magnetic marker according to claim 6 which is made flat or made into a line by plastic working and has a thickness t in a range of 10 μm≦t≦500 μm.

8. A magnetic marker wherein the bias material for a magnetic marker according to claim 6 is disposed so that a bias magnetic field may be applied to a magnetostrictive element for a magnetic marker.

9. A production method of a bias material for a magnetic marker comprising making flat or making into a line a melt prepared of materials comprising 2.0%≦Cu≦10.0% and 0.5%≦Nb≦5.0% by mass %, the balance being Fe and inevitable impurities, wherein the impurities, C, Si, Mn, P, S, Al, N and O are controlled to C≦0.02%, Si≦0.50%, Mn≦0.60%, P≦0.05%, S≦0.02%, Al≦0.05%, N≦0.05% and O≦0.05% by mass %.

* * * * *